US007723006B2

(12) United States Patent
Kim

(10) Patent No.: US 7,723,006 B2
(45) Date of Patent: May 25, 2010

(54) TONER FOR ELECTROSTATIC DEVELOPMENT AND ITS FABRICATION METHOD BY TREATMENT OF SUSPENSION WITH REVERSE-NEUTRALIZATION

(75) Inventor: Do-Gyun Kim, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1324 days.

(21) Appl. No.: 10/498,919

(22) PCT Filed: Dec. 14, 2002

(86) PCT No.: PCT/KR02/02358

§ 371 (c)(1),
(2), (4) Date: Feb. 18, 2005

(87) PCT Pub. No.: WO03/052520

PCT Pub. Date: Jun. 26, 2003

(65) Prior Publication Data

US 2005/0142474 A1 Jun. 30, 2005

(30) Foreign Application Priority Data

Dec. 15, 2001 (KR) ..... 10-2001-0079880
Dec. 15, 2001 (KR) ..... 10-2001-0079881
Dec. 18, 2001 (KR) ..... 10-2001-0080974

(51) Int. Cl.
*G03G 9/087* (2006.01)

(52) U.S. Cl. ..... 430/137.14; 430/109.3; 430/109.4; 430/137.1; 430/137.19

(58) Field of Classification Search ..... 430/137.1, 430/137.19, 137.14, 137.17, 109.3, 109.4
See application file for complete search history.

(56) References Cited

U.S. PATENT DOCUMENTS 5,317,060 A 5/1994 Kukimoto et al.
5,635,584 A 6/1997 Ekart et al.
5,691,095 A 11/1997 Shinzo et al.
5,698,223 A 12/1997 Mychajlowskij et al.
5,885,743 A * 3/1999 Takayanagi et al. ..... 430/108.6
5,948,584 A * 9/1999 Hashimoto et al. ..... 430/109.3
6,248,491 B1 * 6/2001 Takayanagi et al. .... 430/123.53
2003/0040554 A1 * 2/2003 Nakanishi et al. ..... 523/221

FOREIGN PATENT DOCUMENTS

| | | |
|---|---|---|
| EP | 0 743 563 | 11/1996 |
| GB | 838669 | 6/1960 |
| JP | 08-211655 | 8/1996 |
| JP | 10-133416 | 5/1998 |
| JP | 11-288132 | 10/1999 |
| JP | 2000-010343 | 1/2000 |
| JP | 2001-154404 | 6/2001 |
| KR | 10-0184325 | 4/1999 |
| KR | 10-0185630 | 4/1999 |
| WO | WO-01/69325 A1 * | 9/2001 |

* cited by examiner

*Primary Examiner*—Janis L Dote
(74) *Attorney, Agent, or Firm*—Roylance, Abrams, Berdo & Goodman, L.L.P.

(57) ABSTRACT

The present invention relates to a toner for electrostatic development produced by a suspension process accompanied with reverse-neutralization and the method of producing the toner. The method for producing the toner for use in electrostatic development according to an embodiment includes (a) reacting a linear low molecular weight polymer having carboxyl groups at the end of a polymer chain with a basic compound to convert the polymer into neutral salt form and adding distilled water to prepare a water-dispersible composition to function as a dispersant; (b) mixing the water-dispersible resin composition with a colorant, a charge control agent, a releasing agent and a cross-linked high molecular weight water-dispersible latex to form a colored resin dispersion using high shear force; (c) pouring the colored resin dispersion into an acidic solution while applying a high shear force to reverse neutralize the neutral salt and heating and stabilizing the solution to obtain toner particles; and (d) filtering and washing, two or three times, repeatedly, and vacuum drying the toner particles and mixing the dried toner particles with hydrophobic silica particles or hydrophobic titanium oxide particles in an amount of 1-5 wt %.

22 Claims, 3 Drawing Sheets

TONER FOR ELECTROSTATIC DEVELOPMENT AND ITS FABRICATION METHOD BY TREATMENT OF SUSPENSION WITH REVERSE-NEUTRALIZATION

TECHNICAL FIELD

The present invention relates to a toner for electrostatic development produced by a suspension process accompanied with reverse-neutralization and the method of making the toner. More particularly, the invention relates to a toner produced by a suspension treatment accompanied with reverse-neutralization for a low molecular weight linear polymer with carboxyl groups at the end of a polymer chain and the method of making the toner.

BACKGROUND ART

In a electrophotography or a electrostatic recording, there is formed an electrostatic latent image on a photo-conductor by a charging and a exposure process, and the latent image is developed by a developer and transferred to media, thereby being visualized as an image through a fusing process. Here, whether a clear image with excellent quality can be generated depends on various conditions in a developing and a fusing process. In a developing process, the quality of developed image is determined by electrical characteristics and a particle size of toner adhered to a latent image, and a degree of dispersion of various additives in a toner composition. In a fusing process, the image quality is determined by melt characteristics of toner fused and a degree of release property. Accordingly, the improvement of toner performance is required continuously.

There are a polymerization and a crushing method in methods of making toner. In the crushing method, there are mixed a binder resin, a colorant, charge control agents and release agents in a kneader, and, then, the mixture is heated, melted and crushed, thereby producing a toner. However, in the crushing method, it is impossible to disperse finely particles and, therefore, the additives are not able to function properly. Moreover, the yield of product having a desirable particle size is low because a range of particle distribution is broad, and toner performance tends to be poor because spherical particles are not produced.

There are emulsion aggregation and suspension polymerization steps in the polymerization method. The emulsion aggregation method comprises making latex through a emulsion polymerization of polymerizable monomer; mixing it with a colorant, charge control agents, release agents and so on; and heating them over several hours to tens hours with continuous agitation so that emulsion particles are aggregated, thereby forming desirable particles with a particular size. Examples of such method are disclosed in Japanese Patent Publication Nos. 63-282752, 63-282756 and 06-250439, U.S. Pat. Nos. 5,352,521, 4,996,127 and 4,797,339, Korean Patent Publication Nos. 1997-066730 and 1998-073192, and Korean Patent No. 0340303. However, the emulsion aggregation has a broad range of particle distribution and cannot produce fine particles because it is carried out through a long-running aggregation process. Another problem is poor fusing property due to a large molecular weight and high fusing point elasticity.

The suspension polymerization comprises pre-mixing monomers with a colorant, charge control agents and release agents; dispersing them using high shear force to form monomer drops, which can provide desirable particle diameters; adding a stabilizer and polymerizing them; and precipitating formed polymers to obtain polymer particles. An advantage of the suspension polymerization is to be able to produce fine particles of toner. Examples of such method are disclosed in Japanese Patent Publication Nos. 61-118758, 07-128909, and 09-311503, U.S. Pat. Nos. 5,219,697 and 5,288,577, Korean Patent Publication No. 2000-057424, and Korean Patent Nos. 0341786 and 0285183. However, the conventional suspension polymerization method has several problems. For one thing, it is difficult to adjust degree of polymerization because additives counteract polymerization reaction. Moreover, defectives can be produced by abnormal reactions due to instability. Another disadvantage is a poor fusing property due to a high softening point of the produced toner particles.

DISCLOSURE OF INVENTION

Accordingly, the present invention is directed to a toner for electrostatic development and the method of making the toner that substantially obviates one or more problems due to limitations and disadvantages of the related art. The method of making the toner according to the present invention is composed of making a linear low molecular weight polymer having carboxyl groups at the end of (a) the polymer chain, which can be easily dispersed in water due to reaction of a functional group of the molecule with a basic compound; making a water-dispersible resin composition using the linear low molecular weight polymer; and producing a toner with fine particles and a narrow range of particle distribution through a suspension process with reverse-neutralization. An object of the present invention is to provide a method of making a toner that has excellent fusing and separation property and desirable offset property, and that does not generate fog and deterioration of toner according to wear by use, thereby providing a high quality image.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

A method of making a toner for use in an electrostatic development by a suspension process accompanied with reverse-neutralization according to an embodiment of the present invention comprises:

(a) reacting a linear low molecular weight polymer having carboxyl groups at the end of the polymer chain with a basic compound to convert the polymer into neutral salt form and adding distilled water to the reaction product to prepare a water-dispersible resin composition as a dispersant;

(b) mixing the water-dispersible resin composition with a colorant, a charge control agent, and a releasing agent and further adding a cross-linked high molecular weight water-dispersible latex to the mixture to form a colored resin dispersion using high shear force;

(c) pouring the colored resin dispersion into an aqueous acidic solution containing acid compounds while applying a high shear force to the acidic solution and heating and stabilizing to reverse neutralize the neutral salt of the linear low molecular weight polymer to obtain toner particles; and (d) filtering and washing the toner particles two or three times, repeatedly, and vacuum drying, and mixing the dried toner particles with hydrophobic silica particles or hydrophobic titanium oxide particles in the range of 1 to 5 wt % based on the amount of the toner particles.

Reference will now be made in detail to the preferred embodiments of the present invention, examples of which are illustrated in the accompanying drawings.

Figure 1:
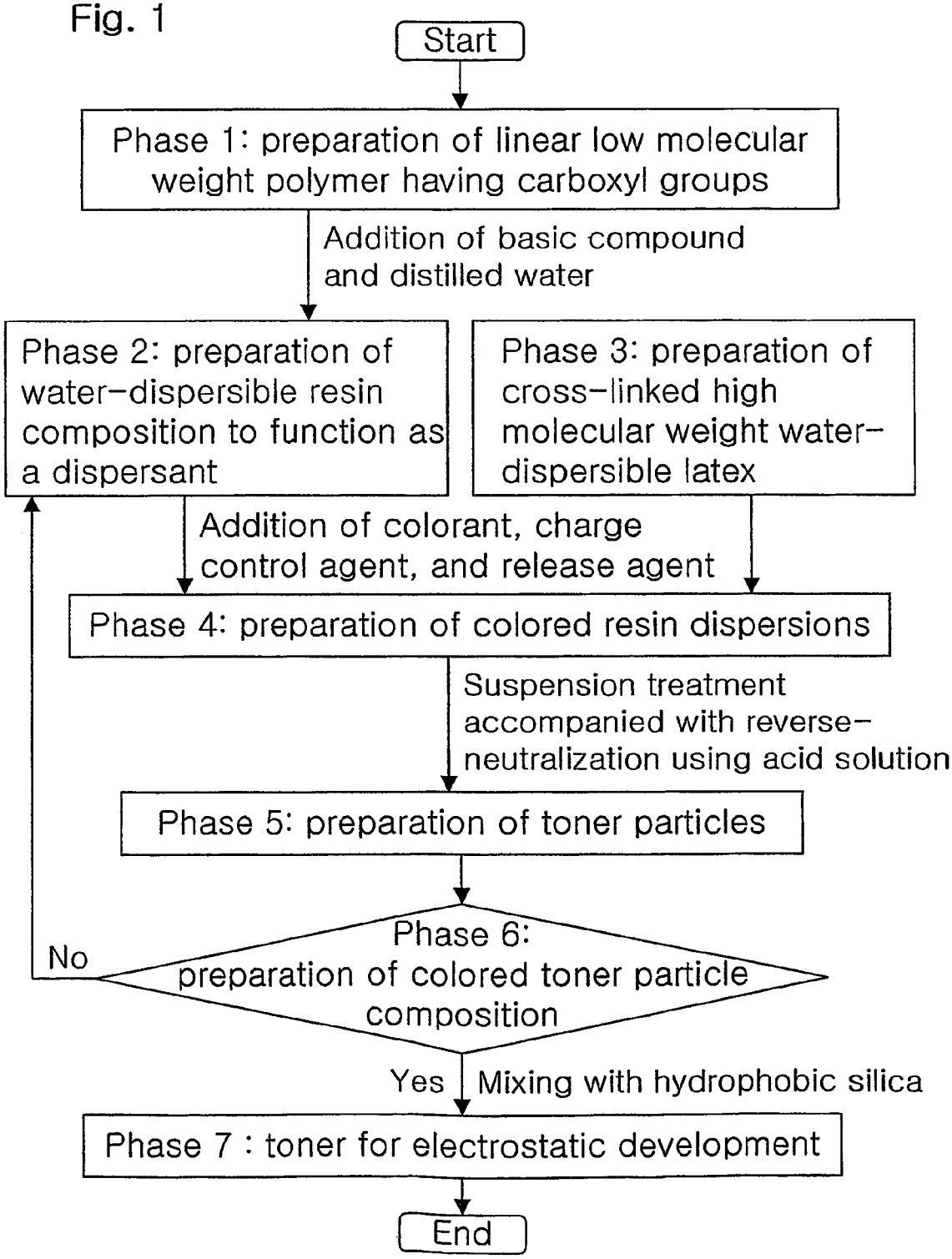
FIG. 1 is a flow chart of a method of making a toner for electrostatic development by a suspension process accompanied with reverse-neutralization in accordance with an embodiment of the present invention.

FIG. 1 is a flow chart of a method of making a toner for electrostatic development by a suspension process accompanied with reverse-neutralization in accordance with an embodiment of the present invention. As shown in FIG. 1, the method of making a toner for electrostatic development comprises:

A method of making a toner for use in an electrostatic development by a suspension process accompanied with reverse-neutralization according to an embodiment of the present invention comprises:

(a) reacting a linear low molecular weight polymer having carboxyl groups at the end of the polymer chain with a basic compound to convert the polymer into neutral salt form and adding distilled water to the reaction product to prepare a water-dispersible resin composition as a dispersant;

(b) mixing the water-dispersible resin composition with a colorant, a charge control agent, and a releasing agent and further adding a cross-linked high molecular weight water-dispersible latex to the mixture to form a colored resin dispersion using high shear force;

(c) pouring the colored resin dispersion into an aqueous acidic solution containing acid compounds while applying a high shear force to the acidic solution and heating and stabilizing the solution to reverse neutralize the neutral salt of the linear low molecular weight polymer to obtain toner particles; and (d) filtering and washing the toner particles two or three times, repeatedly, and vacuum drying, and mixing the dried toner particles with hydrophobic silica particles or hydrophobic titanium oxide particles in the range of 1 to 5 wt % based on the amount of the toner particles.

If the particles of the colored toner particle composition from step (d) are bad, the particles are filtrated and inputted to step (a), and are retreated according to the same processes mentioned above.

The linear low molecular weight polymer from step (a) is produced by a solution polymerization method. The solution polymerization method comprises dissolving monomers in an inactive solvent and to polymerize the monomers in the solution under an appropriate solvent-soluble catalyst. The monomers to be used in the present invention can be selected from the group of aromatic vinyl monomers, acrylate monomers, and monomers capable of being copolymerizable with the aromatic vinyl monomers or acrylate monomers. Examples of suitable aromatic vinyl monomers include styrene, methyl styrene, dimethyl styrene, and halogenated styrene. The amount of the aromatic vinyl monomer to be used is 20~80 wt %, based on the total amount of the monomer mixture. Examples of suitable acrylate monomers include methyl(meth)acrylate, butyl acrylate, 2-ethyl hexyl acrylate, acrylic acid, methacrylic acid and glycidyl methacrylate. The amount of the acrylate monomer to be used is 5~50 wt %, based on the total amount of the monomer mixture. Examples of monomers capable of copolymerizing with the monomers mentioned above include acrylonitrile butadiene and methacrylonitrile, and the amount of the monomer to be used is 5~50 wt %, based on the total amount of the monomer mixture. The monomer selected from the group consisting of (meth)acrylic acid, maleic anhydride, maleic rosin, fumaric acid and itaconic acid are added to form carboxyl groups to the end of the polymer chain. The proportion of the monomers to be used is adjusted according to fusing property of a toner, a softening point in view of the melting property and a glass transition temperature. The solvents to be used at the solution polymerization can be selected from the group of alcohols, ketones, cellosolves, tetrahydrofuran, n-methylpyrrolidone, dimethyl formamide, and a mixture thereof. The amount of the solvent to be used is 20~100 wt %, based on the total amount of the monomer mixture. The solvent used can be completely eliminated by decompression after finishing the polymerization reaction. Polymerization initiators to be used can be selected from the group of benzoyl peroxide, 2,2-azobis isobutyronitrile, dimethyl 2,2-azobis(2-methyl propionate), 2,2-azobis(2,4-dimethyl valeronitrile), di-t-butyl peroxide, dicumyl peroxide, lauroyl peroxide and t-butylperoxy-2-ethyl hexanoate. The amount of the polymerization initiator to be used is 0.01~3 wt %, based on the total amount of the monomer mixture. As the polymerization initiator, oil-soluble radical initiators are more preferable. Molecular weight controllers to be used can be selected from the group of t-dodecyl mercaptan, n-dodecyl mercaptan, n-octyl mercaptan, carbon tetrachloride and carbon tetrabromide. The amount of the molecular weight controller to be used is 0.01~10 wt %, based on the total amount of the monomer mixture. The resultant linear low molecular weight polymer has a number-average molecular weight of 5,000~50,000 and an acid value of 10~110 mg KOH/g.

In addition, a linear low molecular weight polyester resin can be produced from step (a), and, therefore, a polyester resin toner can be produced using it. The linear low molecular weight polyester resin is a polymer having an acid value of 10~110 mg KOH/g. The linear low molecular weight polyester resin can be produced by using excess of polybasic acids in the reaction of polybasic acids with polyhydric alcohols, and the making method thereof comprises producing a linear low molecular weight polyester resin through a first reaction, which produce a low molecular weight polymer using a linear structure forming accelerant, and to carry out a second reaction by adding polybasic acids to it so that the polyester resin has two or three carboxyl groups at the end of the polymer chain.

Figure 3:
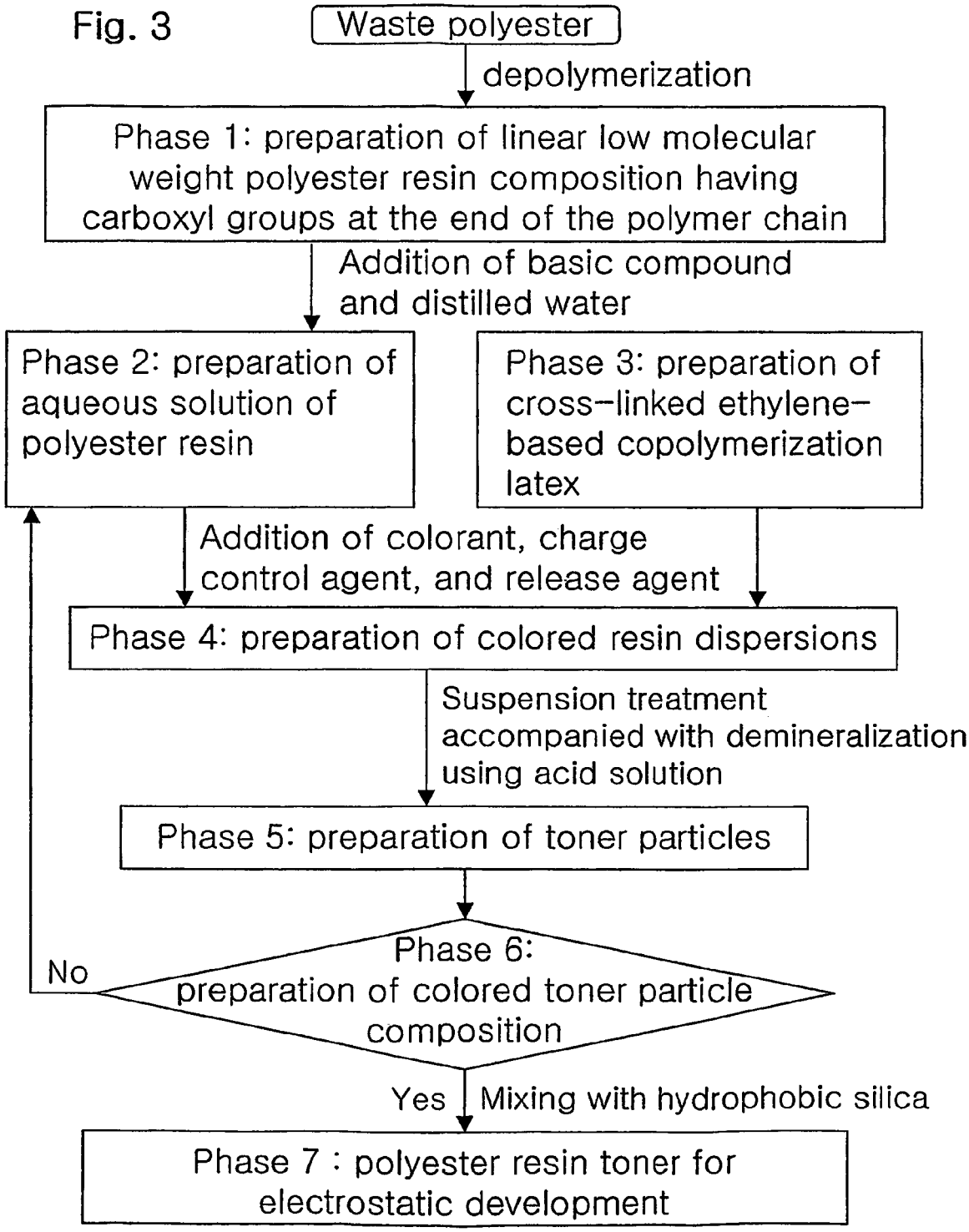
FIG. 3 is a flow chart of a method of making a toner for electrostatic development by a suspension process accompanied with reverse-neutralization using a reclaimed polyester resin according to still another embodiment of the present invention.

Here, on the contrary, said polyester resin can be produced from depolymerizing a waste polyester resin to carry out an addition reaction so that the polyester resin has two or three carboxyl groups at the end of the polymer chain. Specially, as shown in FIG. 3, the polyester resin can be produced by depolymerizing a waste polyester resin using a solid resin dissolvent, carrying out an addition reaction accompanied with a second depolymerization using polybasic acids, and causing polycondensation reaction through adding polyhydric alcohols under a tin based catalyst. The making method of a toner using a waste polyester resin will be explained in Example 8 in detail.

In the method of making said polyester resin, materials to facilitate linear structure and to induce the formation of low molecular weight polymer can be selected from the group of rosin, wood rosin, rosin derivatives, terpene-based resins, petroleum resin and derivatives thereof, dicyclopentadiene (hereinafter referred to as "DCPD") and derivatives thereof gum rosin, dehydrogenated rosin, hydrogenated rosin, maleic rosin, rosin ester, pinene resin, dipentene resin, C5 petroleum resins, C9 petroleum resins, dammar resin, copal resin, DCPD resin, hydrogenated DCPD resin, styrene maleic resin, and a mixture thereof. The amount of the material to be used is 10~100 wt %, based on the total amount of monomers.

Examples of polybasic acids to be used include phthalic anhydride, isophthalic acid, terephthalic acid, adipic acid, azelaic acid, sebacic acid, tetrahydro phthalic anhydride, maleic anhydride, fumaric acid, itaconic acid, trimellitic anhydride, pyromellitic anhydride, benzoic acid, and a mixture thereof. The amount of the polybasic acid to be added is 10~90 wt %, based on the total amount of monomers. Examples of the polyhydric alcohols to be used include ethylene glycol, propylene glycol, 1,3-propanediol, 1,3-butanediol, 1,6-hexanediol, neopentyl glycol, diethylene glycol, dipropylene glycol, polyethylene glycol, alkylene oxide adduct of bisphenol A, trimethylol propane, glycerin, pentaerythritol, and a mixture thereof. The amount of the polyhydric alcohol to be used is 10~90 wt %, based on the total amount of monomers. As a catalyst, metal organic acid or tin based catalysts can be used at the amount of 0.05~0.5 wt %, based on the total amount of monomers. In order to combine carboxyl groups to the end of the polymer chain, there can be selected trimellitic anhydride, trimellitic acid, pyromellitic anhydride, pyromellitic acid, maleic anhydride, maleic acid, fumaric acid, adipic acid, benzoic acid, sebacic acid, maleic rosin, maleic styrene, maleic isobutylene, and a mixture thereof at the amount of 10~70 wt %, based on the amount of the polyester resin.

The water-dispersible resin composition to function as a dispersant in step (a) is produced by neutralizing the linear low molecular weight polymer using basic compounds, and adding distilled water. Examples of suitable basic compounds to be used include sodium hydroxide, potassium hydroxide, ammonium hydroxide, lithium hydroxide, and amines. The amount of the basic compound to be used is 5~50 wt % based on the amount of the linear low molecular weight polymer.

The cross-linked high molecular weight water-dispersible latex in step (b) is produced by emulsion polymerization, which emulsifies monomers in water containing a water-soluble catalyst and emulsifier and polymerizes them. There are used 20~90 wt % of styrene, 5~90 wt % of acrylate-based monomer and 5~50 wt % of cross-linked monomer. Examples of suitable anionic surfactants to be used include sodium stearate, sodium lauryl sulfate, sodium dodecylbenzene sulfonate, and a mixture thereof. The amount of the anionic surfactant to be used is 1~20 wt %, based on the total amount of the monomer mixture. Examples of suitable nonionic surfactants to be used include poly(oxyethylene) nonyl phenyl ether, octyl methoxy polyethyl oxyethanol, sorbitan lauryl ethylene oxide adduct and a mixture thereof. The amount of the nonionic surfactant to be used is 1~30 wt %, based on the total amount of the monomer mixture. Examples of suitable water-soluble initiators to be used include potassium persulfate, ammonium persulfate, sodium bisulphate and sodium bicarbonate. The amount of the water-soluble initiator to be used is 0.01~2 wt %, based on the total amount of the monomer mixture. The resultant cross-linked high molecular weight water-dispersible latex has a gel content of 5~50 wt % and a weight average molecular weight of 100,000~1,000,000.

In step (b), there are produced colored resin dispersions by using the water-dispersible resin composition from step (a), the cross-linked high molecular weight water-dispersible latex, a colorant, charge control agents and release agents. Examples of suitable colorants include black pigments such as carbon black, acetylene black and magnetite, yellow pigments such as iron oxide yellow, hansa yellow and permanent yellow, blue pigments such as phthalocyanine blue and violet, red pigments such as iron oxide red, carmine, toluidine red and quinacridone red, and green pigments such as phthalocyanine green and chrome green. The amount of the colorant to be used is 1~50 wt %, based on the amount of a binder resin. The suitable charge control agents can be selected from the group of negrosin, quaternary ammonium salts, salicylic acid-based metal salts and metal-azo compounds (e.g., BONTRON N-01, BONTRON N-07, BONTRON S-24 and BONTRON E-84 available from Orient Chemical Co., Ltd. (Japan)). The amount of the charge control agents to be used is 0.5~15 wt %, based on the amount of a binder resin. The suitable release agents can be selected from the group of paraffin wax, polyethylene wax, carnauba wax, montan wax, ester wax and Sasol wax. The amount of the release agents to be used is 1~30 wt %, based on the amount of a binder resin.

In step (c), there are produced toner particles by a suspension process accompanied with reverse-neutralization using acid compounds. The suitable acid compounds can be selected from the group of hydrochloric acid, sulfuric acid, nitric acid, acetic acid, formic acid, oxalic acid, hydrofluoric acid, phosphoric acid, bromic acid, and p-toluene sulfonic acid. The amount of the acid compound to be used is 5~50 wt %, based on the amount of the colored resin dispersions. In step (d), the amount of hydrophobic silica, as an external additive, to be used is 1~5 wt %, based on 100 g of the colored toner particle composition from step (d).

The method of making a toner for electrostatic development will be described in further detail with reference to the examples thereof, which examples however are merely intended to be illustrative and not to be construed as limiting the scope of the invention.

EXAMPLE 1

Method for Making a Water-Dispersible Resin Composition

There are prepared 150 grams of ethyl cellosolve, 250 grams of styrene, 120 grams of ethyl hexyl acrylate, 60 grams of acrylic acid, 30 grams of styrene-isoprene diblock copolymer, 1.1 grams of n-dodecyl mercaptan, and 0.5 grams of azobis isobutyronitrile (hereinafter referred to as "AIBN"). A reactor equipped with an agitator, a reflux condenser, a thermometer and a nitrogen inlet port is charged with 2/10 of the mixture of the reactants, and heated to 125° C. and maintained at that temperature with stirring over forty-five minutes. The resultant product is a seed polymer. Then, the rest mixture is little by little added to the reactor slowly, over a 3-hour period at 130° C., and the reactants are heated to 125° C. and maintained over 6 hours at that temperature. The product is diluted by 150 grams of ethyl cellosolve. The resultant polymer has an acid value of 75 mg KOH/g, a glass transition temperature of 35° C., and a weight average molecular weight of 11,000. Finally, there is produced a water-dispersible resin aqueous solution by adding 100 grams of 20% sodium hydroxide solution to said polymer, carrying out the polymerization reaction over thirty minutes at 85° C., and diluting them with 300 grams of distilled water.

EXAMPLE 2

Another Method for Making a Water-Dispersible Resin Composition

A reactor equipped with an agitator, a reflux condenser, a thermometer and a nitrogen inlet port is charged with 150 grams of butyl cellosolve, 250 grams of styrene, 120 grams of butyl acrylate, 60 grams of acrylic acid, 1.1 grams of n-dodecyl mercaptan and 0.5 grams of AIBN. The reaction method is the same with Example 1. The resultant polymer, having an acid value of 81 mg KOH/g, a glass transition temperature of 59° C. and a weight average molecular weight of 9,000 is solubilized and become a water-dispersible resin aqueous solution.

EXAMPLE 3

Method for Making a Cross-Linked High Molecular Weight Water-Dispersible Latex

There are prepared 100 grams of styrene, 100 grams of methyl methacrylate, 100 grams of ethyl acrylate, 6 grams of acrylic acid and 10 grams of divinyl benzene. The mixture of said reactants is little by little added to a solution, which is comprised of 9 grams of anionic emulsifier, 16 grams of nonionic emulsifier and 190 grams of distilled water, to form a preemulsion. Another reactor is charged with 4 grams of anionic emulsifier, 8 grams of nonionic emulsifier, 1.5 grams of potassium persulfate and 200 grams of distilled water, and heated to 80° C. Said preemulsion is little by little added to the second reactor slowly and polymerized over 3 hours at 80° C. The second reactor is then raised to 90° C., and a solution which is prepared by dissolving 1.5 grams of sodium bisulphate in 30 grams of distilled water, is little by little added to the second reactor slowly to cause the reactants to react over 5 hours continuously. Said processes are carried out in reactors equipped with an agitator, a reflux condenser, a thermometer and a nitrogen inlet port. The resultant cross-linked high molecular weight latex emulsion has a glass transition temperature of 65° C., a weight average molecular weight of 300,000 and a gel content of 45%.

EXAMPLE 4

Another Method for Making a Cross-Linked High Molecular Weight Water-Dispersible Latex A mixture composed of 250 grams of styrene, 120 grams of butyl acrylate, 7 grams of acrylic acid and 15 grams of divinyl benzene is little by little added to a solution composed of 10 grams of anionic emulsifier, 16 grams of nonionic emulsifier, and 190 grams of distilled water, to form preemulsion. Another reactor is charged with 5 grams of anionic emulsifier, 8 grams of nonionic emulsifier, 1.5 grams of potassium persulfate and 200 grams of distilled water, and heated to 80° C. The rest process is the same with Example 3. The resultant cross-linked high molecular weight latex emulsion has a glass transition temperature of 55° C., a weight average molecular weight of 350,000 and a gel content of 35%.

EXAMPLE 5

Method for Making a Toner for Electrostatic Development Using the Compositions from the Previous Examples A mixture composed of 3 grams of carbon black (PRINTEX 150 T), 0.5 grams of charge control agent (BONTRON S-34), and 30 grams of distilled water is added to the water-dispersible resin aqueous solution from Example 1 and dispersed by a high-speed disperser to form a colored resin dispersion. A release agent is added and dispersed in the colored resin dispersion. Another reactor is charged with an aqueous solution composed of 5 grams of hydrochloric acid and 100 grams of distilled water. Then, the colored resin dispersions are slowly added to the reactor. The mixture is stirred fast at 50° C. so that toner particles are formed by a suspension process accompanied with reverse-neutralization. The resultant potato-shaped toner particles have a particle diameter of 9 μm and a particle distribution of 1.29 GSD. The toner particles are washed, filtered, and dried. Then, 100 grams of the dried toner particles are mixed with 1 gram of hydrophobic silica (Degussa R972) by means of HENSCHEL MIXER to produce a toner for electrostatic development. A rebuilt toner cartridge (for laser printer ML 6060 made by Samsung Electronics Co., Ltd.) filled with the toner provides a very clear and high quality image.

EXAMPLE 6

Another Method for Making a Toner for Electrostatic Development

A mixture composed of 3 grams of carbon black (PRINTEX 150 T), 0.5 grams of charge control agent (BONTRON S-34), and 30 grams of distilled water is added to the resin solution from Example 2 and dispersed by a high speed disperser to form a colored resin dispersion. The colored resin dispersion is mixed with 50 grams of the cross-linked high molecular weight water-dispersible latex from Example 3. The mixture is again dispersed to mix the colored resin dispersion. Another reactor is charged with a solution, which is prepared by mixing 3.5 grams of hydrochloric acid with 100 grams of distilled water. Then, the colored resin dispersion is slowly added to the reactor with fast stirring at 50° C. so that toner particles are formed by a suspension process accompanied with reverse-neutralization. The resultant potato-shaped toner particles have a particle diameter of 7 μm and a particle distribution of 1.27 GSD. The toner particles are washed, filtered, and dried. Then, 100 grams of the dried toner particles are mixed with 1 gram of hydrophobic silica (Degussa R972) by means of HENSCHEL MIXER to produce a toner for electrostatic development. A rebuilt toner cartridge (for laser printer ML 6060 made by Samsung Electronics Co., Ltd.) filled with the toner provides a very clear and high quality image.

EXAMPLE 7

Figure 2:
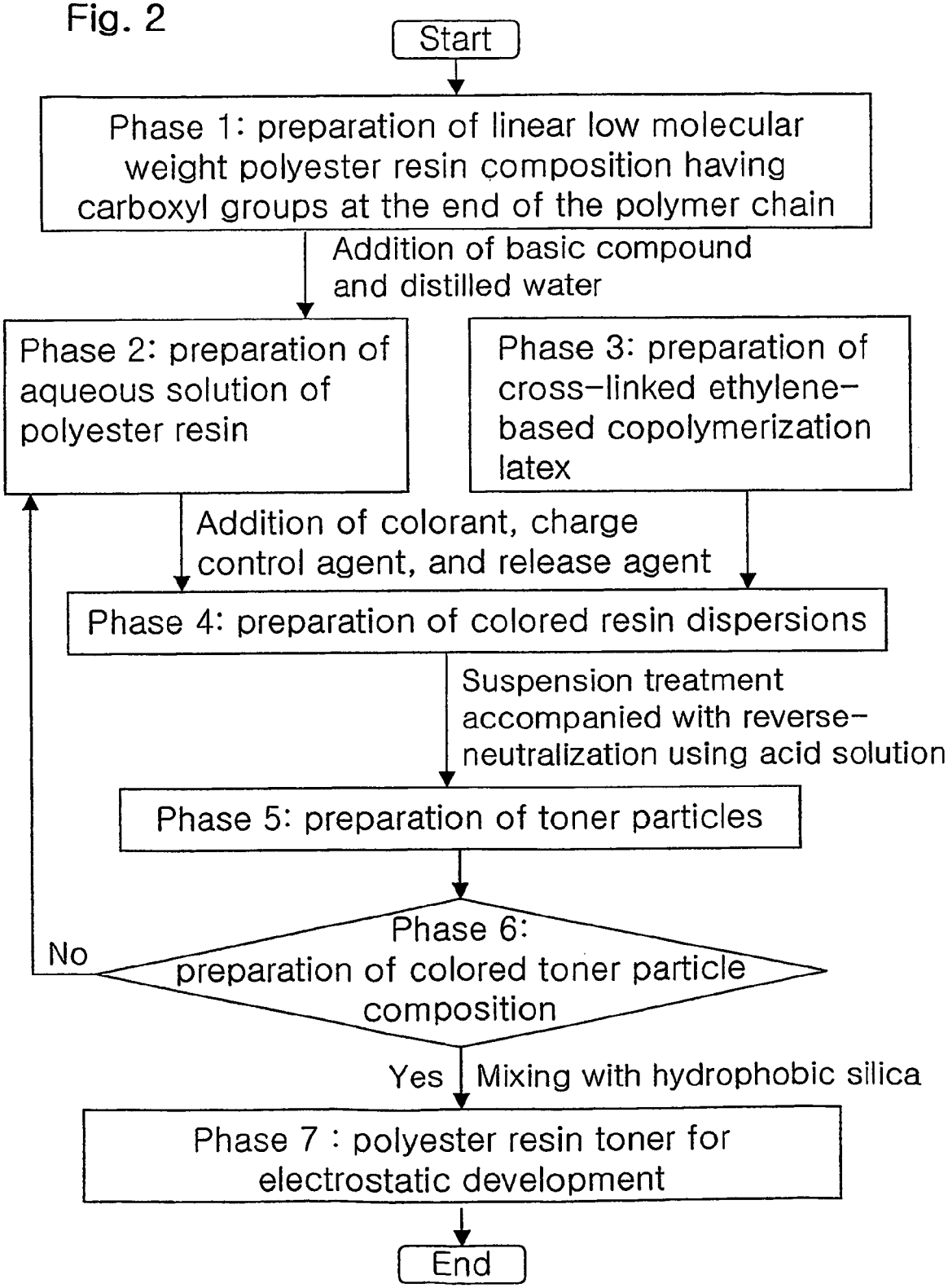
FIG. 2 is a flow chart of a method of making a toner for electrostatic development by a suspension process accompanied with reverse-neutralization according to another embodiment of the present invention.

Preparation of a Toner by a Suspension Process Accompanied with Reverse-Neutralization FIG. 2 shows a method for making a toner for electrostatic development by a suspension process accompanied with reverse-neutralization reaction according to another embodiment of the present invention using a polyester resin which has low melt elasticity, excellent adhesive property, and excellent low temperature fix characteristics such as exfoliation resistance.

As shown in FIG. 2, the method of making a toner for electrostatic development comprises:

(a) reacting a linear low molecular weight polyester resin having carboxyl groups at the end of the polymer chain with a basic compound to convert the linear low molecular weight polyester resin into neutral salt form and adding distilled water to the reaction product to prepare a polyester resin aqueous solution acting as a dispersant;

(b) mixing the polyester resin aqueous solution with a colorant, a charge control agent, and a releasing agent and further adding a cross-linked ethylenic copolymer latex into the mixture to prepare a colored resin dispersion;

(c) pouring the colored resin dispersion into an aqueous acidic solution containing acid compounds while applying a high shear force to the acidic solution and heating to reverse neutralize the neutral salt of the linear low molecular weight polyester resin to obtain toner particles; and (d) filtering, washing, and vacuum drying the toner particles and mixing the dried toner particles with hydrophobic silica particles or titanium oxide particles in an amount of 1 to 5 wt %.

The resultant polyester resin toner has a particle size of 5~15 μm and a narrow range of particle distribution. Here, the linear low molecular weight polyester resin having carboxyl groups at the end of the polymer chain from step (a) is the same as that according to the method of making the present invention, and the rest process and ingredients to be used is the same with other Examples according to the present invention.

EXAMPLE 8

Preparation of a Toner by Using Waste Polyester Resin

A polyester resin having two or three carboxyl groups at the end of the polymer chain is used as a starting material. The polyester resin is prepared by depolymerizing a waste polyester resin to carry out an addition reaction. FIG. 3 is a flow chart according to the method of making Example 8. As shown in FIG. 3, the method of making a toner by using a waste polyester resin according to still another embodiment of the present invention comprises:

(a) producing a linear low molecular weight polyester resin having carboxyl groups at the end of the polymer chain from waste polyester resin by depolymerization;

(b) reacting the linear low molecular weight polyester resin with a basic compound to convert it into neutral salt form and adding distilled water, a hydrophilic solvent, or a mixture thereof to the reaction product to prepare a polyester resin aqueous solution acting as a dispersant (c) mixing the polyester resin aqueous solution with a colorant, a charge control agent, and a releasing agent and further adding a cross-linked ethylenic copolymer latex into the mixture to prepare a colored resin dispersion;

(d) pouring the colored resin dispersion into an aqueous acidic solution containing acid compounds while applying a high shear force to the acidic solution and heating to reverse neutralize the neutral salt of the linear low molecular weight polyester resin to obtain toner particles; and (e) filtering, washing, and vacuum drying the toner particles and mixing the dried toner particles with hydrophobic silica particles or hydrophobic titanium oxide particles in an amount of 1-5 wt %.

The resultant polyester resin toner has 5~15 μm of particle size and a narrow range of particle distribution. In step (a), a waste polyester resin is depolymerized first by a solid resin dissolvent. Then, an addition reaction accompanied with second depolymerization is carried out using polybasic acids. Subsequently, polyhydric alcohols are added to the depolymerization composition and a polycondensation reaction is carried out using a tin-based catalyst. The resultant polyester resin composition has an acid value of 10~110 mg KOH/g, a weight average molecular weight of 3,000~50,000, and a softening point of 70~150° C. The solid resin dissolvent to be used in step (a) is selected from the group of gum rosin, wood rosin, dehydrogenated rosin, hydrogenated rosin; maleic rosin, rosin ester, pinene resin, dipentene resin, C5 petroleum resins, C9 petroleum resins, dammar resin, copal resin, dicyclopentadiene (hereinafter referred to as "DCPD") resin, hydrogenated DCPD resin, styrene maleic resin, and a mixture thereof. The weight ratio of the waste polyester resin to the solid resin dissolvent is preferably 1:9~9:1. The processes and ingredients to be used in Example 8 are the same with those in the previous method according to the present invention, except step (a) depolymerizes a waste polyester resin as a starting material. The resultant toner has a particle diameter of 5~10 μm and a particle distribution of 1.05~1.35 GDS. Example 8 will be described in further detail by referring to preparation examples, which examples are merely intended to be illustrative and not to be construed as limiting the scope of the invention.

PREPARATION EXAMPLE 1

Crushed waste polyethylene terephthalate (hereinafter referred to as "PET") chips (400 g), gum rosin (200 g) and monobutyl stannoic acid (0.3 g) are placed in a reactor which is equipped with an agitator, a reflux condenser, a separator, a thermometer and a nitrogen inlet port. The mixture is heated to 250° C. and maintained at that temperature over 2 hours under a nitrogen atmosphere. The mixture is stirred when it begins to melt. After the mixture changes into a transparent state, the reactor is cooled to 150° C., and then, maleic anhydride (180 g) is added to the reactor. When the temperature of the mixture reaches to the point that ring-opening reaction is finished, the mixture is again heated to 235° C. and maintained at that temperature over 3 hours. The resultant depolymerization product has an acid value of 115 mg KOH/g. Then, ethylene oxide adduct of bisphenol A (200 g) is added to the depolymerization product, and the mixture is maintained at 250° C. over 5 hours to carry out dehydration and polycondensation reaction. When an acid value of the product reaches to 55 mg KOH/g, the reactor is cooled and charged with 50 grams of sodium hydroxide and 1,500 grams of distilled water. Then, the mixture is stirred over thirty minutes at 85° C. The resultant water-soluble polyester resin (hereinafter referred to as "resin solution A") has an acid value of 39 mg KOH/g, a weight average molecular weight of 11,000, a softening point of 80° C. and pH of 8.5.

A mixture composed of 3 grams of carbon black (PRINTEX 150T), 0.5 grams of charge control agent (BONTRON S-34), and 30 grams of distilled water is added to 100 grams of the resin solution A and dispersed by a high speed disperser to form a colored resin dispersion. The colored resin dispersion is mixed with release agents and again dispersed. Another reactor is charged with an aqueous solution which is prepared by mixing 5 grams of hydrochloric acid with 100 grams of distilled water. Then, the colored resin dispersion is slowly added to the reactor with fast stirring at 50° C. so that toner particles are formed by a suspension process accompanied with reverse-neutralization. The resultant potato-shaped toner particles have a particle diameter of 9 μm and a particle distribution of 1.29 GSD. The obtained toner particles are washed, filtered, and dried. Subsequently, 100 grams of the dried toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co., Ltd.) filled with the toner provides a very clear and high quality image.

PREPARATION EXAMPLE 2

Crushed waste PET chips (400 g), hydrogenated rosin (200 g), monobutyl stannoic acid (0.3 g), trimellitic anhydride (150 g) and neopentyl glycol (200 g) are placed in a reactor which is equipped with an agitator, a reflux condenser, a separator, a thermometer and a nitrogen inlet port. The reaction method is the same with Preparation Example 1. The resultant water-soluble polyester resin (hereinafter referred to as "resin solution B") has an acid value of 30 mg KOH/g, a weight average molecular weight of 12,000, a softening point of 95° C., and pH of 8.7.

A mixture composed of 3 grams of carbon black (PRINTEX 150T), 0.5 grams of charge control agent (BONTRON S-34), and 30 grams of distilled water is added to 100 grams of the resin solution B and dispersed by a high speed disperser to form a colored resin dispersion. The colored resin dispersion is mixed with release agents and again dispersed. Another reactor is charged with an aqueous solution which is prepared by mixing 5 grains of hydrochloric acid with 100 grams of distilled water. Then, the colored resin dispersion is slowly added to the reactor with fast stirring at 50° C. so that toner particles are formed by a suspension process accompanied with reverse-neutralization. The resultant potato-shaped toner particles have a particle diameter of 10 μm and a particle distribution of 1.31 GSD. The obtained toner particles are washed, filtered, and dried. Subsequently, 100 grams of the died toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co., Ltd) filled with the toner provides a very clear and high quality image.

PREPARATION EXAMPLE 3

Crushed waste PET chips (400 g), rosin ester (200 g), monobutyl stannoic acid (0.3 g), fumaric acid (150 g), neopentyl glycol (10 g) and diethylene glycol (100 g) are placed in a reactor which is equipped with an agitator, a reflux condenser, a separator, a thermometer and a nitrogen inlet port. The reaction method is the same with Preparation Example 1, except that 55 grams of potassium hydroxide is used as a neutralizer instead of sodium hydroxide. The resultant water-soluble polyester resin (hereinafter referred to as "resin solution C") has an acid value of 28 mg KOH/g, a weight average molecular weight of 12,000, a softening point of 105° C., and pH of 8.1.

A mixture composed of 3 grams of carbon black (PRINTEX 150T), 0.5 grams of charge control agent (BONTRON S-34), and 30 grams of distilled water is added to 100 grams of the resin solution C and dispersed by a high speed disperser to form a colored resin dispersion. The colored resin dispersion is mixed with release agents and again dispersed. Another reactor is charged with an aqueous solution which is prepared by mixing 5 grams of hydrochloric acid with 100 grams of distilled water. Then, the colored resin dispersion is slowly added to the reactor with fast stirring at 50° C. so that toner particles are formed by a suspension process accompanied with reverse-neutralization. The resultant potato-shaped toner particles have a particle diameter of 11 μm and a particle distribution of 1.31 GSD. The obtained toner particles are washed, filtered, and dried. Subsequently, 100 grams of the dried toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co., Ltd.) filled with the toner provides a very clear and high quality image.

PREPARATION EXAMPLE 4

Crushed waste PET chips (350 g), maleic gum rosin (250 g), monobutyl stannoic acid (0.3 g), trimellitic anhydride (10 g), neopentyl glycol (50 g) and ethylene oxide adduct of bisphenol A (150 g) are placed in a reactor which is equipped with an agitator, a reflux condenser, a separator, a thermometer and a nitrogen inlet port. The reaction method is the same with Preparation Example 1. The resultant water-soluble polyester resin (hereinafter referred to as "resin solution D") has an acid value of 45 mg KOH/g, a weight average molecular weight of 11,500, a softening point of 81° C., and pH of 8.7.

A mixture composed of 3 grams of carbon black (PRINTEX 150T), 0.5 grams of charge control agent (BONTRON S-34), and 30 grams of distilled water is added to 100 grams of the resin solution D and dispersed by a high speed disperser to form a colored resin dispersion. The colored resin dispersion is mixed with release agents and again dispersed. Another reactor is charged with an aqueous solution which is prepared by mixing 5 grams of hydrochloric acid with 100 grams of distilled water. Then, the colored resin dispersion is slowly added to the reactor with fast stirring at 50° C. so that toner particles are formed by a suspension process accompanied with reverse-neutralization. The resultant potato-shaped toner particles have a particle diameter of 8 μm and a particle distribution of 1.29 GSD. The obtained toner particles are washed, filtered, and dried. Subsequently, 100 grams of the dried toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co, Ltd.) filled with the toner provides a very clear and high quality image.

PREPARATION EXAMPLE 5

50 grams of the polyester resin aqueous solution from Preparation Example 1 is added to a mixture composed of 3 grams of carbon black (PRINTEX 150T), 0.5 grams of charge control agent (BONTRON S-34), and 30 grams of distilled water, and the mixture is dispersed by a high speed disperser to form a colored resin dispersion. The colored resin dispersion is mixed with 50 grams of latex from Example 3. The mixture is again dispersed to mix the colored resin dispersion. Another reactor is charged with a solution which is prepared by mixing 3.5 grams of hydrochloric acid with 100 grams of distilled water. Then, the colored resin dispersion is added to the reactor with fast stirring at 50° C. so that toner particles are formed by a suspension process accompanied with reverse-neutralization. The resultant potato-shaped toner particles have a particle diameter of 7 μm and a particle distribution of 1.29 GSD. The obtained toner particles are washed, filtered, and dried. Then, 100 grams of the dried toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co., Ltd.) filled with the toner provides a very clear and high quality image.

PREPARATION EXAMPLE 6

50 grams of the polyester resin aqueous solution from Preparation Example 2 is added to a mixture composed of 3 grams of carbon black (PRINTEX 150T), 0.5 grams of charge control agent (BONTRON S-34), and 30 grams of distilled water, and the mixture is dispersed by a high speed disperser to form a colored resin dispersion. The colored resin dispersion is mixed with 50 grams of latex from Example 3. The mixture is again dispersed to mix the colored resin dispersion. Another reactor is charged with a solution which is prepared by mixing 3.5 grams of hydrochloric acid with 100 grams of distilled water. Then, the colored resin dispersion is added to the reactor with fast stirring at 50° C. so that toner particles are formed by a suspension process accompanied with reverse-neutralization. The resultant potato-shaped toner particles have a particle diameter of 9 μm and a particle distribution of 1.33 GSD. The obtained toner particles are washed, filtered, and dried. Then, 100 grams of the dried toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co., Ltd.) filled with the toner provides a very clear and high quality image.

PREPARATION EXAMPLE 7

50 grams of the polyester resin aqueous solution from Preparation Example 3 is added to a mixture composed of 3 grains of carbon black (PRINTEX 150T), 0.5 grams of charge control agent (BONTRON S-34), and 30 grams of distilled water, and the mixture is dispersed by a high speed disperser to form a colored resin dispersion. The colored resin dispersion is mixed with 50 grams of latex from Example 3. The mixture is again dispersed to mix the colored resin dispersion. Another reactor is charged with a solution which is prepared by mixing 3.5 grams of hydrochloric acid with 100 grams of distilled water. Then, the colored resin dispersion is added to the reactor with fast stirring at 50° C. so that toner particles are formed by a suspension process accompanied with reverse-neutralization. The resultant potato-shaped toner particles have a particle diameter of 10 μm and a particle distribution of 1.35 GSD. The obtained toner particles are washed, filtered, and dried. Then, 100 grams of the dried toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co., Ltd.) filled with the toner provides a very clear and high quality image.

PREPARATION EXAMPLE 8

50 grams of the polyester resin aqueous solution from Preparation Example 4 is added to a mixture composed of 3 grams of carbon black (PRINTEX 150T), 0.5 grams of charge control agent (BONTRON S-34), and 30 grams of distilled water, and the mixture is dispersed by a high speed disperser to form a colored resin dispersion. The colored resin dispersion is mixed with 50 grams of latex from Example 3. The mixture is again dispersed to mix the colored resin dispersion. Another reactor is charged with a solution which is prepared by mixing 3.5 grams of hydrochloric acid with 100 grams of distilled water. Then, the colored resin dispersion is added to the reactor with fast stirring at 50° C. so that toner particles are formed by a suspension process accompanied with reverse-neutralization. The resultant potato-shaped toner particles have a particle diameter of 8 μm and a particle distribution of 1.26 GSD. The obtained toner particles are washed, filtered, and dried. Then, 100 grams of the dried toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co., Ltd.) filled with the toner provides a very clear and high quality image.

PREPARATION EXAMPLE 9

50 grams of the polyester resin aqueous solution from Preparation Example 1 is added to a mixture composed of 3 grams of carbon black (PRINTEX 150T), 0.5 grams of charge control agent (BONTRON S-34), and 30 grams of distilled water, and the mixture is dispersed by a high speed disperser to form a colored resin dispersion. The colored resin dispersion is mixed with 50 grams of latex from Example 4. The mixture is again dispersed to mix the colored resin dispersion. Another reactor is charged with a solution which is prepared by mixing 3.5 grams of hydrochloric acid with 100 grams of distilled water. Then, the colored resin dispersion is added to the reactor with fast stirring at 50° C. so that toner particles are formed by a suspension process accompanied with reverse-neutralization. The resultant potato-shaped toner particles have a particle diameter of 9 μm and a particle distribution of 1.27 GSD. The obtained toner particles are washed, filtered, and dried. Then, 100 grams of the dried toner particles is mixed with 1 gram of hydrophobic silica (Degussa R972) by means of HENSCHEL MIXER to produce a toner for electrostatic development. A rebuilt toner cartridge (for laser printer ML6060 made by Samsung Electronics Co., Ltd.) filled with the toner provides a very clear and high quality image.

INDUSTRIAL APPLICABILITY

Thus, the making method of a toner for electrostatic development according to present invention can easily and rapidly produce a toner composition through a suspension process accompanied with reverse-neutralization. The toner according to the present invention has fine particles with diameter of less than 10 μm and narrow particle distribution of 1.30 GSD. Accordingly, the toner of the present invention has excellent fusing and separation property and desirable offset property, and does not generate fog and deterioration of toner according to wear by use. In addition, because the toner of the present invention can be again dissolved in a basic solution to form toner particles through a suspension process accompanied with reverse-neutralization, it is possible to recycle waste toners.

What is claimed is:

1. A method for making a toner for electrostatic development by a suspension process accompanied with reverse-neutralization, the method comprising:

(a) reacting a linear low molecular weight polymer having carboxyl groups at the end of a polymer chain with a basic compound to convert the polymer into neutral salt form and adding distilled water to the reaction product to prepare a water-dispersible resin composition as a dispersant;

(b) mixing the water-dispersible resin composition with a colorant, a charge control agent, and a releasing agent using high shear force to form a colored resin dispersion;

(c) pouring the colored resin dispersion into an aqueous acidic solution containing at least one acid compound while applying a high shear force to the acidic solution to reverse neutralize the neutral salt of the linear low molecular weight polymer and heating and stabilizing the solution to obtain toner particles; and (d) filtering and washing the toner particles two or three times repeatedly, and vacuum drying to form dried toner particles and mixing the dried toner particles with hydrophobic silica particles or titanium oxide particles in the range of 1-5 wt % based on the amount of the toner particles.

2. The method of claim 1, wherein the linear low molecular weight polymer is polymerized from a monomer mixture including an aromatic vinyl monomer, an acrylate monomer, and a monomer that is copolymerizable with an aromatic vinyl monomer or the acrylate monomer.

3. The method of claim 2, wherein the linear low molecular weight polymer comprises 20-80 wt % of an aromatic vinyl monomer or 5-50 wt % of an acrylate monomer.

4. The method of claim 2, wherein the monomer that is copolymerizable with the aromatic vinyl monomer or the acrylate monomer forms the carboxyl group to the chain end of the linear low molecular weight polymer and is at least one selected from the group consisting of (meth)acrylic acid, maleic anhydride, maleic rosin, fumaric acid, and itaconic acid.

5. The method of claim 4, wherein the amount of the monomer that is copolymerizable with the aromatic vinyl monomer or the acrylate monomer for forming the carboxyl group to the chain end of the linear low molecular weight polymer is 5-50 wt %, based on the total amount of mixture.

6. The method of claim 1, wherein the linear low molecular weight polymer has a number average molecular weight of 5,000-50,000.

7. The method of claim 1, wherein the linear low molecular weight polymer has an acid value of 10-110 mg KOH/g.

8. The method of claim 1, wherein the basic compound is at least one selected from the group consisting of sodium hydroxide, potassium hydroxide, lithium hydroxide, ammonium hydroxide, and an amine.

9. The method of claim 1, wherein the amount of the basic compound is in the range of 5-50 wt % based on the amount of the linear low molecular weight polymer.

10. The method of claim 1, further comprising the step of adding a crosslinked high molecular weight water-dispersible latex to the water-dispersible resin composition, where the high molecular weight water-dispersible latex has a weight average molecular weight of 100,000-1,000,000.

11. The method of claim 10, wherein the high molecular weight water-dispersible latex has a gel content of 5-50 wt %.

12. The method of claim 1, wherein the at least one acid compound is at least one selected from the group consisting of hydrochloric acid, sulfuric acid, nitric acid, acetic acid, formic acid, oxalic acid, hydrofluoric acid, phosphoric acid, bromic acid, and p-toluene sulfonic acid.

13. The method of claim 1, wherein the amount of the acid compound is in the range of 5-50 wt % based on the amount of the colored resin dispersion.

14. The method of claim 1, wherein further adding a crosslinked high molecular weight water-dispersible latex to the mixture in step (b).

15. A method for making a toner for electrostatic development by a suspension process accompanied with reverse-neutralization, the method comprising:

(a) reacting a linear low molecular weight polyester resin having carboxyl groups at the end of a polymer chain with a basic compound to convert the linear low molecular weight polyester resin into neutral salt form and adding distilled water to the reaction product to prepare a polyester resin solution acting as a dispersant;

(b) mixing the polyester resin aqueous solution with a colorant, a charge control agent, and a releasing agent to prepare a colored resin dispersion;

(c) pouring the colored resin dispersion into an aqueous acidic solution containing at least one acid compound while applying a high shear force to the acidic solution to reverse neutralize the neutral salt of the linear low molecular weight polyester resin and heating the solution to obtain toner particles; and (d) filtering, washing, and vacuum drying the toner particles and mixing the dried toner particles with hydrophobic silica particles or titanium oxide particles in the range of 1-5 wt % based on the amount of the toner particles.

16. The method of claim 15, wherein the linear low molecular weight polyester resin is produced by:

reacting a polybasic acid with a polyhydric alcohol in the presence of a material to promote the formation of a linear low molecular weight polyester resin precursor; and further reacting the linear low molecular weight polyester resin precursor with a polybasic acid to add two or three carboxyl groups to the chain end of the linear low molecular weight polyester resin precursor to form the linear low molecular weight polyester resin.

17. The method of claim 16, wherein the material to promote the formation of a linear low molecular weight polyester resin precursor is at least one selected from the group consisting of rosin, wood rosin, terpene-based resins, petroleum resin, dicyclopentadiene (DCPD), gum rosin, dehydrogenated rosin, hydrogenated rosin, maleic rosin, rosin ester, pinene resin, dipentene resin, C5 petroleum resins, C9 petroleum resins, dammar resin, copal resin, DCPD resin, hydrogenated DCPD resin, and styrene maleic resin.

18. The method of claim 15, wherein further adding a crosslinked ethylenic copolymer latex to the mixture in step (b).

19. A method for making a toner for electrostatic development by a suspension process accompanied with reverse-neutralization, the method comprising:

(a) producing a linear low molecular weight polyester resin having carboxyl groups at the end of the polymer chain from waste polyester resin by depolymerization;

(b) reacting the linear low molecular weight polyester resin with a basic compound to convert it into neutral salt form and adding distilled water, a hydrophilic solvent, or a mixture thereof to the reaction product to prepare a polyester resin aqueous solution acting as a dispersant;

(c) mixing the polyester resin aqueous solution with a colorant, a charge control agent, and a releasing agent to prepare a colored resin dispersion;

(d) pouring the colored resin dispersion into an aqueous acidic solution containing at least one acid compound while applying a high shear force to the acidic solution to reverse neutralize the neutral salt of the linear low molecular weight polyester resin and heating the solution to obtain toner particles; and (e) filtering, washing, and vacuum drying the toner particles and mixing the dried toner particles with hydrophobic silica particles or titanium oxide particles in the range of 1-5 wt % based on the amount of the toner particles.

20. The method of claim 19, wherein the linear low molecular weight polyester resin is produced by:

reacting the waste polyester resin with a solid resin solvent to provide a first depolymerizable product;

reacting the first depolymerized product with a polybasic acid to provide a second depolymerized product; and reacting the second depolymerized product with a polyhydric alcohol in the presence of a tin-based catalyst to polycondense the second depolymerized product;

wherein the solid resin solvent to depolymerize the waste polyester resin is at least one selected from the group consisting of gum rosin, wood rosin, dehydrogenated rosin, hydrogenated rosin, maleic rosin, rosin ester, pinene resin, dipentene resin, C5 petroleum resins, C9 petroleum resins, dammar resin, copal resin, DCPD resin, hydrogenated DCPD resin, and styrene maleic resin.

21. The method of claim 20, wherein the mixing weight ratio of the waste polyester resin to the solid resin solvent is in the range of 1:9-9:1.

22. The method of claim 19, wherein further adding a crosslinked ethylenic copolymer latex to the mixture in step (c).

* * * * *